US007390145B2

(12) United States Patent
Wall

(10) Patent No.: US 7,390,145 B2
(45) Date of Patent: Jun. 24, 2008

(54) CONNECTION ELEMENT FOR SHEET PILES

(75) Inventor: Georg Wall, Muich (DE)

(73) Assignee: Pilepro, LLC, Austin, TX (US)

( * ) Notice: Subject to any disclaimer, the term of this patent is extended or adjusted under 35 U.S.C. 154(b) by 0 days.

(21) Appl. No.: 11/292,886

(22) Filed: Dec. 2, 2005

(65) Prior Publication Data

US 2007/0003379 A1 Jan. 4, 2007

(30) Foreign Application Priority Data

Dec. 2, 2004 (DE) ..... 20 2004 018 659 U

(51) Int. Cl.
*E02D 5/08* (2006.01)

(52) U.S. Cl. ..... 405/278; 405/281; 405/279

(58) Field of Classification Search ..... 405/278, 405/279, 281, 274, 276, 277; D8/382
See application file for complete search history.

(56) References Cited

U.S. PATENT DOCUMENTS

| | | | | |
|---|---|---|---|---|
| 1,098,077 | A | 5/1914 | Annison | |
| 1,460,263 | A * | 6/1923 | Ver Mehr et al. | 405/281 |
| 1,681,593 | A * | 8/1928 | Pahl | 405/279 |
| 2,642,018 | A * | 6/1953 | Weeber | 52/277 |
| 3,688,508 | A * | 9/1972 | Taylor | 405/278 |
| D242,138 | S * | 11/1976 | Drawsky et al. | D25/119 |
| 5,292,208 | A * | 3/1994 | Berger | 405/281 |
| 6,042,306 | A * | 3/2000 | Arndts et al. | 405/279 |
| 6,092,346 | A * | 7/2000 | Even et al. | 52/579 |
| 6,428,244 | B1 * | 8/2002 | Wall | 405/279 |
| D471,793 | S * | 3/2003 | Wall | D8/382 |
| D521,365 | S * | 5/2006 | Wall | D8/382 |
| D526,888 | S * | 8/2006 | Heindl | D8/382 |
| 2002/0102131 | A1 | 8/2002 | Wall | |

FOREIGN PATENT DOCUMENTS

| | | |
|---|---|---|
| DE | 39 07 348 A1 | 3/1989 |
| DE | 203 19 175 U1 | 12/2003 |

* cited by examiner

*Primary Examiner*—Frederick L Lagman
(74) *Attorney, Agent, or Firm*—Milde & Hoffberg, LLP

(57) ABSTRACT

The connection element according to the present invention includes a central strip and two hook strips issuing from it that together form a claw strip with C-shaped cross section. The ends of the hook strips point toward each other, and with their ends, define an open jaw. Additionally, the extended central lines of the ends of the hook strips intersect outside the open jaw. Extending from the claw strip is at least one connection strip that possesses a straight neck strip and a head strip that is oval in cross section. The major axis of the oval head strip is perpendicular to the longitudinal axis of the neck strip.

13 Claims, 5 Drawing Sheets

CONNECTION ELEMENT FOR SHEET PILES

BACKGROUND OF THE INVENTION

The invention concerns a connection element for sheet piles.

Connection elements of this type are used to connect sheet piles which then form a sheet pile wall. Such connection elements are often used to connect the attachment elements at each edge of two sheet pile walls at an angle. Examples for such attachment elements may be taken from the Published German Patent Application DE-A1-39 07 348. The attachment elements described there serve to connect to so-called Larssen sheet piles or sheet piles of the claw/knob type.

When sheet piles and their attachment elements are rammed into place, high tension and shearing forces arise between these components that may be so great that the sheet piles with their attachment elements disengage. This may weaken the overall strength of the sheet pile wall and at these locations this sheet pile wall is no longer watertight.

SUMMARY OF THE INVENTION

It is a principal object of the present invention to provide a connection element for sheet piles that is simple to manufacture, and by means of which the connection elements and sheet piles may remain engaged when subject to high forces while being rammed into place.

This object, as well as further objects which will become apparent from the discussion that follows, are achieved, in accordance with the present invention, by providing a connection element having the following configuration:

The connection element according to the present invention includes a central strip and two hook strips issuing from it that together form a claw strip with C-shaped cross section. The ends of the hook strips point toward each other and, with their ends, define an open jaw. Additionally, the extended central lines of the ends of the hook strips intersect outside the open jaw. Extending from the claw strip is at least one connection strip that possesses a straight neck strip and a head strip that is oval in cross section. The major axis of the oval head strip (viewed in cross section) is perpendicular to the longitudinal axis of the neck strip.

It is noted at this point for clarification that the directions of the central lines, the major axis, the various longitudinal axes, and the axis of symmetry as described herein are to be viewed in a cross-sectional plane perpendicular to the longitudinal direction of the respective connection elements shown and described.

The connection element according to the present invention serves especially to join together sheet piles with ball/socket connectors. For this, the claw strip serves to receive the ball joint of the sheet pile, while the socket joint of the sheet pile is brought into engagement with the head strip of the connection element.

On one hand, the configuration of the claw strip according to the invention simplifies the insertion of the sheet pile with its ball connection into the claw strip since the jaw of the claw strip is enlarged by the progression of the two hook strips toward each other according to which the two central lines intersect each other, outside the jaw of the claw strip. On the other hand, disengagement of the ball connection from the claw strip is prevented during ramming by the configuration of the present invention since the hook strips largely surround the ball connection of the sheet pile inserted into the claw strip, without preventing compensation motion of the ball connection and the claw strip with respect to each other.

Simultaneously, the hook strips can take up the high forces involved in ramming and can transfer them to the central strip.

The connection strip is especially configured to connect with the socket connection of the sheet pile. For this, the socket connection of the sheet pile encloses or surrounds the head strip of the connection strip over an extended region, so that disengagement of the head strip from the socket connection is prevented during the ramming (installation) process.

The connection element according to the invention may be made of metal or plastic using an extruder press. When made of metal, it is further possible to produce the connection element according to the invention using either a hot (warm) or cold rolling process.

The connection strip may in principle be provided at any point on the claw strip, so that the sheet piles may be connected with one another at a specific angle by means of the connection element.

In one advantageous embodiment of the connection element according to the invention, the connection strip is a continuation of the central strip of the C-shaped claw strip so that the longitudinal axis of the neck strip is aligned with the longitudinal axis of the connection strip, and coincides with it. This allows sheet piles to be connected together at an angle of about 90°.

In another advantageous embodiment of the connection element according to the invention, the connection strip on the side opposite to the open jaw branches off the central strip, making possible the interconnection of a row or line of sheet piles.

Further, it is proposed according to the invention, to equip the connection element with two connection strips. The one connection strip is preferably shaped as a continuation of the central strip, while the second connection strip branches off from the central strip, perpendicular thereto, on the side opposite the open jaw of the claw strip. Such a configuration allows three sheet piles to be connected with one another, whereby the claw strip and the connection strips compensate any adjustment motion of the sheet piles with respect to one another.

In an alternative embodiment of the connection element according to the invention, two C-shaped claw strips and a connection strip are provided. This also allows the connection of three sheet piles with one another. In this embodiment the central strip of the first C-shaped claw strip forms, at least partially, one of the two hook strips of the second C-shaped claw strip. The second C-shaped claw strip is preferably so formed on the connection element that the axis of symmetry of the second claw strip extends at least approximately perpendicular to the axis of symmetry of the first claw strip, allowing the connection of sheet piles that extend basically perpendicular to each other.

The inner and outer contours of the cross section of the connection element according to the invention are formed in the area of the claw strip, or claw strips, and the connection strip, or connection strips, preferably by a succession of circular arcs.

For a full understanding of the present invention, reference should now be made to the following detailed description of the preferred embodiments of the invention as illustrated in the accompanying drawings.

DESCRIPTION OF THE PREFERRED EMBODIMENTS

The preferred embodiments of the present invention will now be described with reference to FIGS. 1-5 of the drawings.

Figure 1:
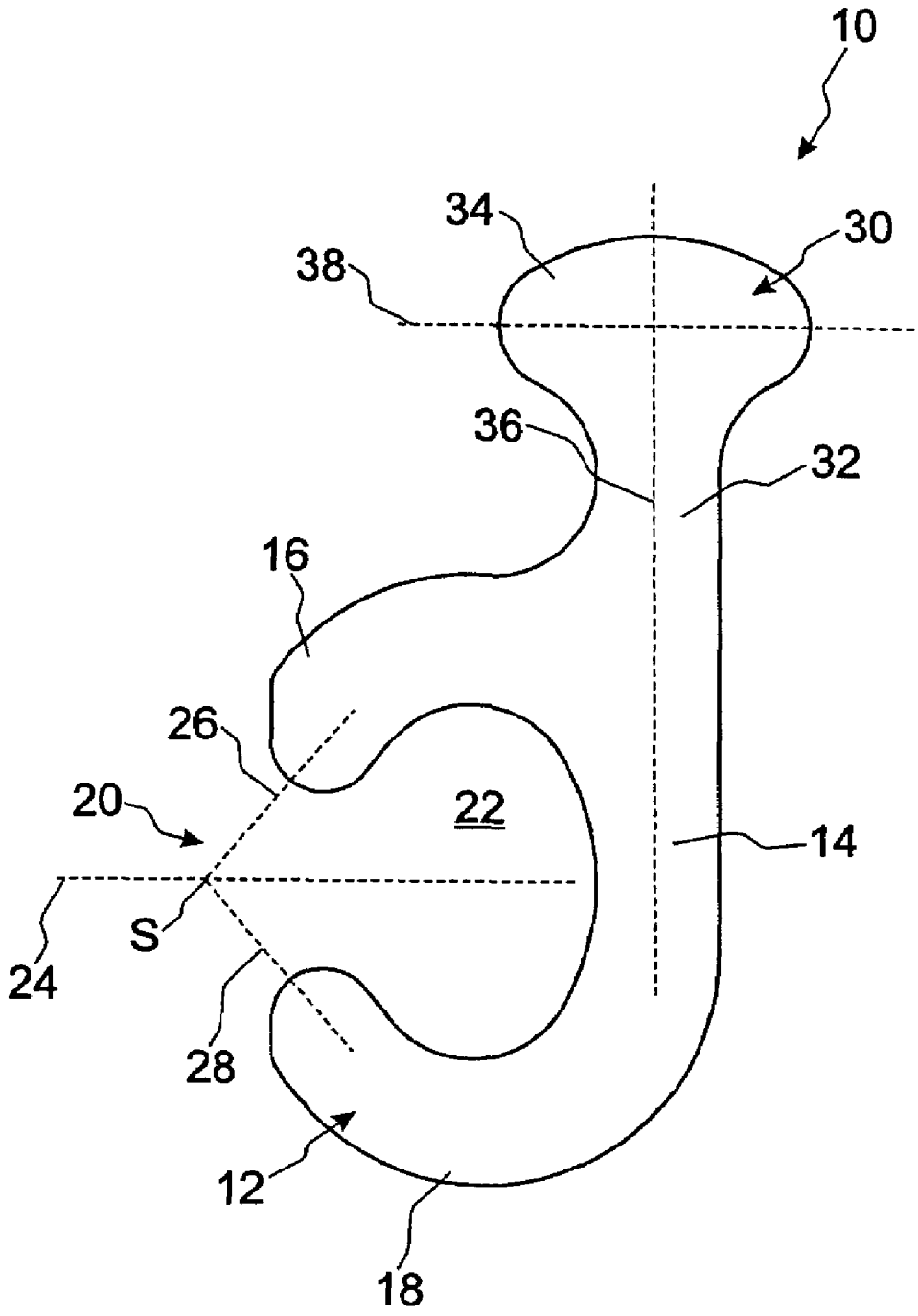
FIG. 1 is a front view of the end face of a first preferred embodiment of a connection element according to the invention with a C-shaped claw strip and a connection strip.

FIG. 1 shows the end face of a first preferred embodiment of a connection element 10 according to the invention. The connection element 10 has a substantially constant cross-sectional profile along its length, and has a length corresponding to the length of the sheet piles with which it is to be connected.

The connection element 10 includes a claw strip 12 with a C-shaped cross section that is formed from the central strip 14 and from the two hook strips 16 and 18. The central strip 14 merges into the hook strips 16 and 18, forming the C-shaped claw strip 12. The ends of the hook strips 16 and 18 face each other and define an open jaw 20.

The central strip 14 and the hook strips 16 and 18 have essentially the same thickness and extend toward each other so that the C-shaped claw strip 12 possesses an approximately oval interior 22 in cross section.

The cross section of the claw strip 12 is mirror-symmetrical along an axis of symmetry 24 through the midpoint of the open jaw 20 and the center of the central strip 14. If one extends the center lines 26 and 28 of the hook strips 16 and 18, then these center lines 26 and 28 intersect the axis of symmetry 24 of the claw strip 12 at a intersection point S outside the open jaw 20. The distance of the intersection point S corresponds to approximately one-half to one-and-a-half times the thickness of the hook strips 16 and 18 or of the central strip 14.

The connection element 10 per FIG. 1 further includes a connection strip 30 that is shaped as a continuation of the central strip 14 of the claw strip 12. The connection strip 30 possesses a straight neck strip 32 as well as a head strip 34 adjacent to it. The neck strip 32 has a length, along its longitudinal axis 36, of approximately one to two times the thickness of the central strip 14. The head strip 34 possesses an oval cross section, with the major axis 38 of the oval extending perpendicular to the longitudinal axis 36 of the neck strip 32. The width of the oval along the major axis 38 corresponds approximately to two to three times the thickness of the neck strip 32.

Figure 2:
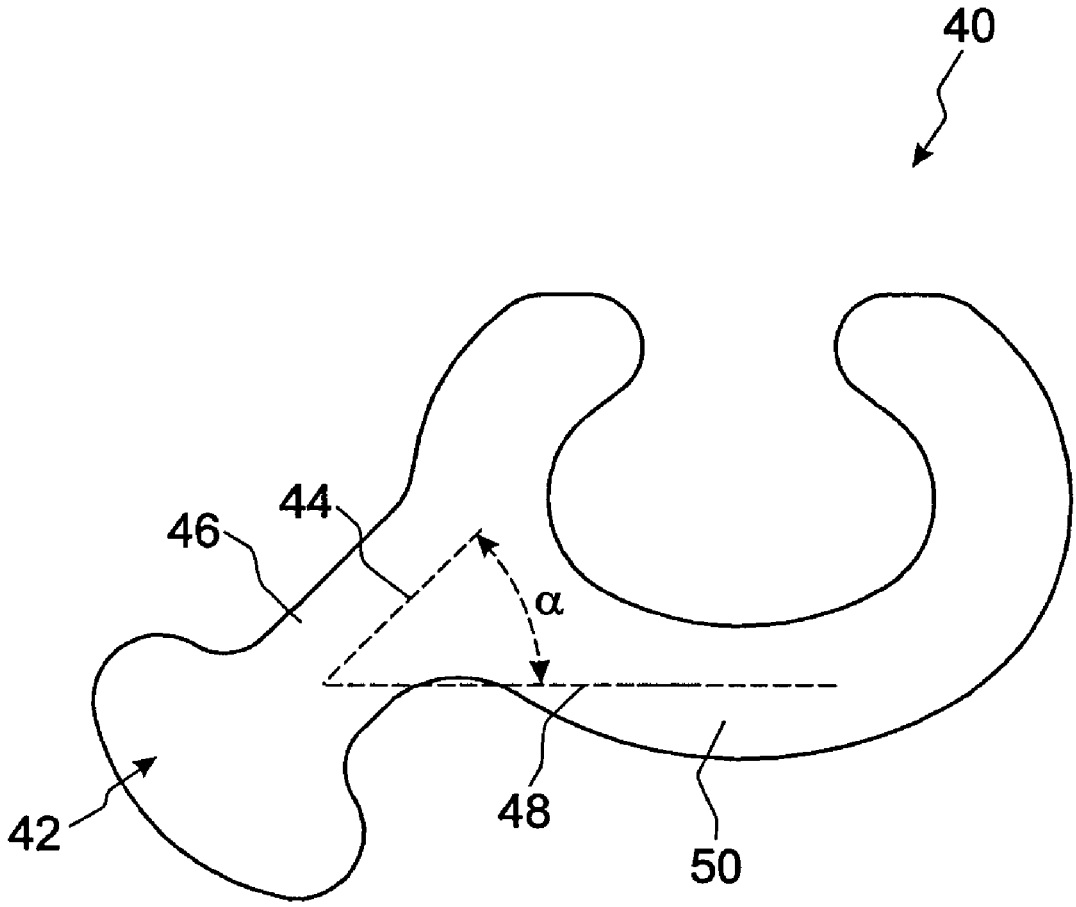
FIG. 2 is a front view of the end face of a first variation of the connection element shown in FIG. 1, in which the connection strip opposite the C-shaped claw strip extends at an angle with respect to the claw strip.

FIG. 2 shows a front view of the end face of a variation of the connection element 10 shown in FIG. 1. In this variation 40, the connection strip 42, with the longitudinal axis 44 of its neck strip 46, extends at an angle $\alpha$ of approximately 45° to the longitudinal axis 48 of the central strip 50. This allows sheet piles to be connected together at an angle of 45°.

Figure 3:
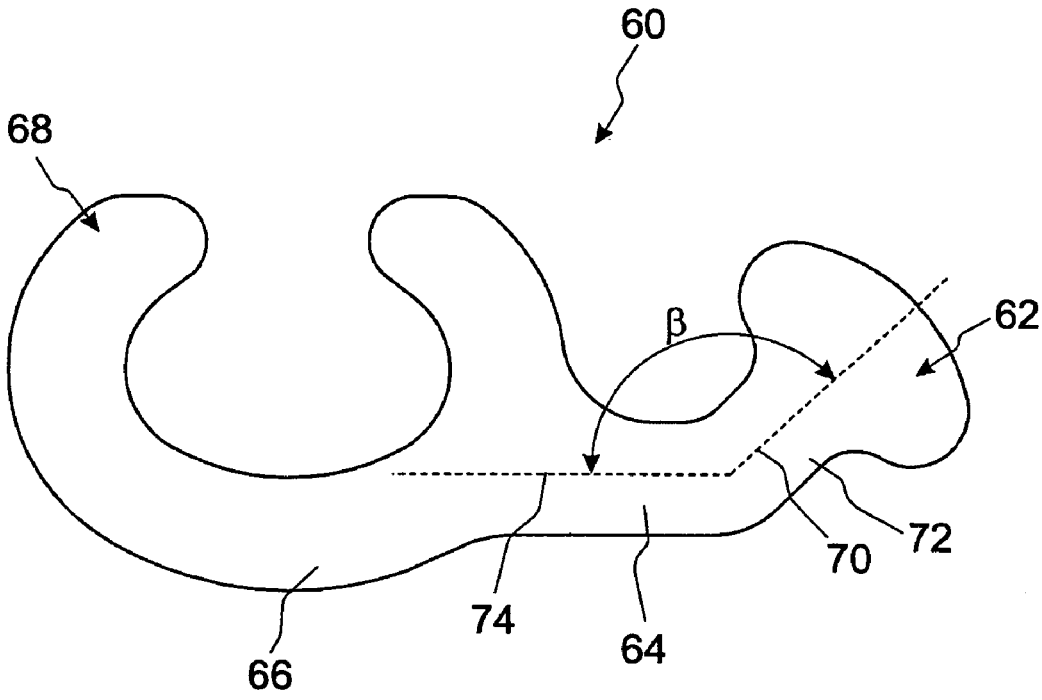
FIG. 3 is a front view of the end face of a second variation of the connection element shown in FIG. 1 in which the connection strip opposite the C-shaped claw strip is angled.

FIG. 3 shows a front view of the end face of a second variation of the connection element 10 shown in FIG. 1. In this variation 60, the connection strip 62 merges into the central strip 66 of the C-shaped claw strip 68 via an intermediary strip 64. In this case the longitudinal axis 70 of the neck strip 72 of the connection strip 62 extends at an angle $\beta$ of about 45° with respect to the longitudinal axis 74 of the intermediary strip 64. The intermediary strip 64 allows two sheet piles to be joined together at an acute angle.

Figure 4:
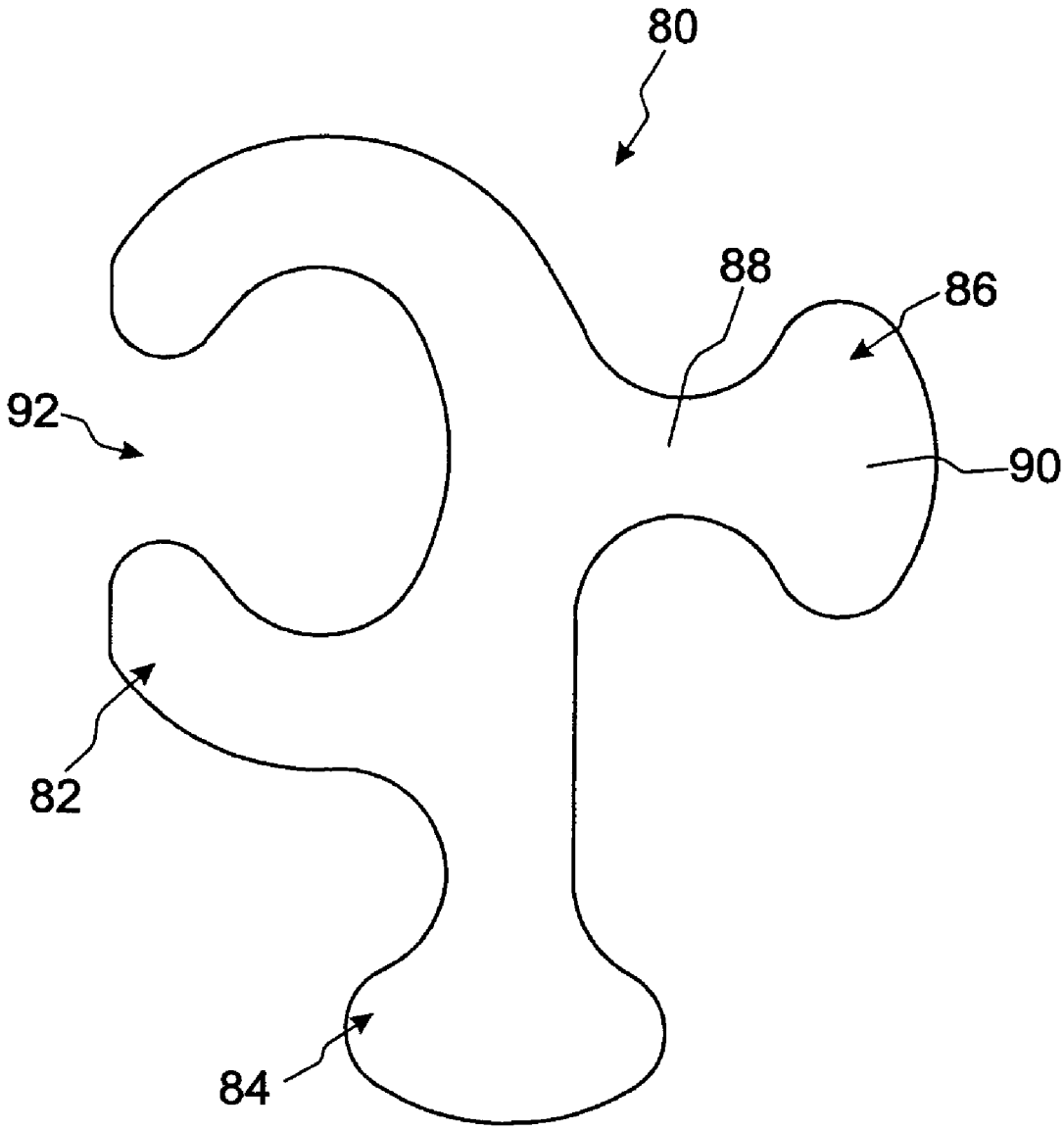
FIG. 4 is a front view of the end face of a second preferred embodiment of a connection element according to the invention with a C-shaped claw strip and two opposing connection strips.

FIG. 4 shows a front view of the end face of a second preferred embodiment of the invention; namely, a modified connection element 80 that, as in the case of the first preferred embodiment in FIG. 1, includes a C-shaped claw strip 82 and a first connection strip 84. The dimensions of these components correspond to those of the components of the connection element 10 shown in FIG. 1.

In this case, a second connection strip 86 is provided for this connection element 80 that is designed like the first connection strip 84 and that includes a neck strip 88 and a head strip 90. The dimensions of this second connection strip 86 correspond to those of the respective first connection strip 84. The second connection strip 86 is positioned on the side of the claw strip 82 opposite the open jaw 92, and is perpendicular to the first connection strip 84.

Figure 5:
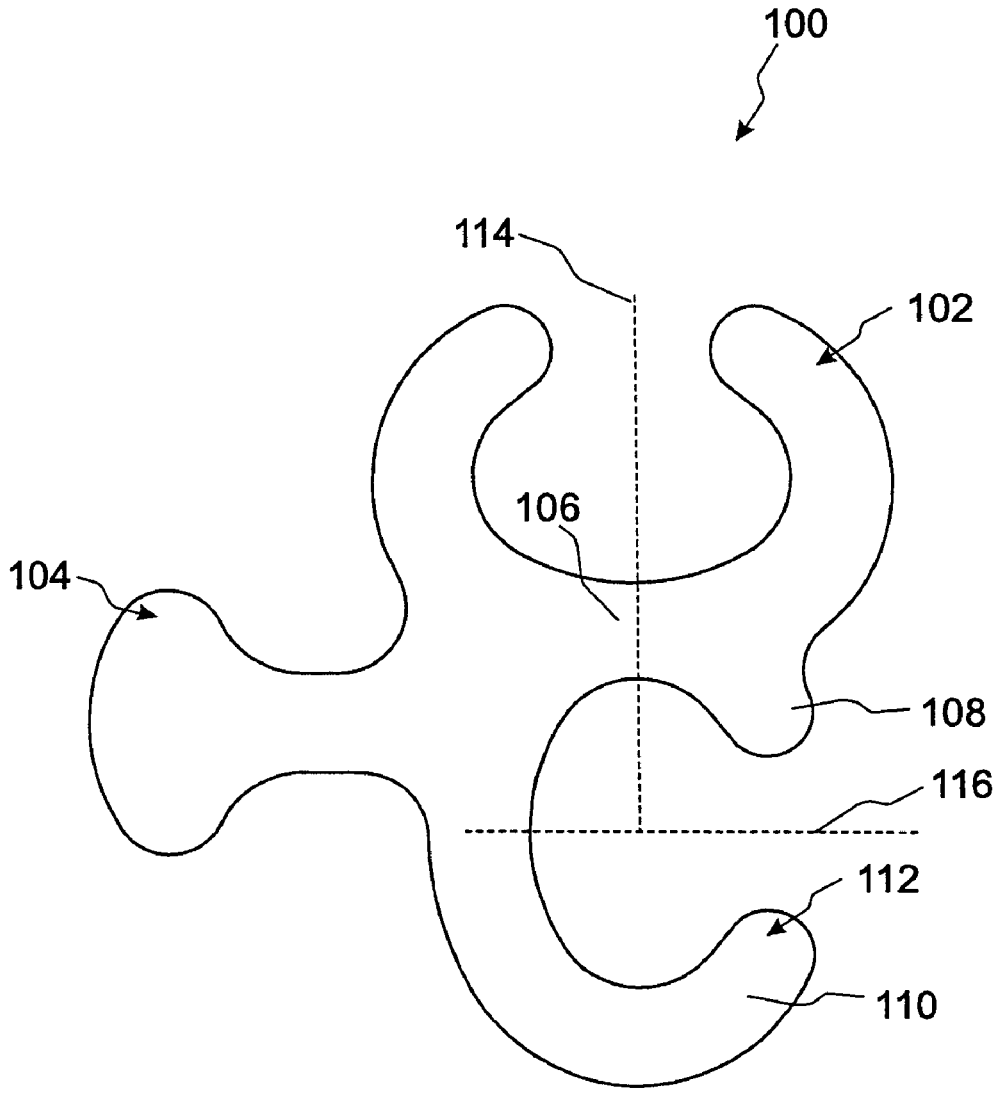
FIG. 5 is a front view of the end face of a third preferred embodiment of a connection element according to the invention with two C-shaped claw strips extending perpendicular to each other with a connection strip opposite them.

FIG. 5 shows a front view of the end face of a third preferred embodiment of a connection element 100 according to the invention. Connection element 10 shown in FIG. 1 possesses the same C-shaped claw strip 102 and connection strip 104 as does connection element 100 of FIG. 5. The central strip 106 of the claw strip 102, however, forms one of the hook strips 108 and 110 of a second C-shaped claw strip 112.

The second claw strip 112 possesses the identical shape and dimensions for this connection element as the first C-shaped claw strip 102, but its axis of symmetry 114 extends perpendicular to the axis of symmetry 116 of the first claw strip 102.

As FIGS. 1 through 5 show, the shape of the cross section for all connection elements 10, 40, 60, 80, and 100 in the area of the claw strips 12, 68, 82, 102, and 112 and of the connection strips 30, 42, 62, 84, 86 and 104 is formed by a succession of circular arc segments of varying radii. The inner contour of the claw strips 12, 68, 82, 102 and 112 in the regions facing the central strips 14, 50, 66 and 106 are formed with the relatively large radius of 20 mm, for example, to each of which is adjacent a circular arc with a smaller radius of 8 mm, for example, that is adjacent to the hook strips 16, 18, 108, and 110. The outer contour of the hook strips 16, 18, 108, and 110 extend essentially parallel to this, whereby the strips possess a thickness of about 10 mm.

For the connection elements 10 and 80 shown, respectively, in FIGS. 1 and 4, a circular arc with relatively small radius of 8 mm, for example, is adjacent to the outer contour of the hook strip 16 that merges into the neck strip 32 or 88. The circular arc defining the upper part of the head strip 34 or 90 has, in turn, a comparatively large radius of 16 mm, for example. The other circular arcs are so selected that smooth transitions result.

The connection elements 10, 40, 60, 80, and 100 are shown in FIGS. 1 through 5 at approximately 1.5:1 scale, so that the height of the connection elements 10, 40, 60, 80, and 100 is about 75 mm. The greatest width of the inner contour of the claw strips 12, 68, 82, 102 and 112 is about 28 to 30 mm, and the jaw opening is about 15 mm. The greatest width of the head strips 34 and 90 in the direction of the major axis 38 is about 24 mm.

Deviations from these dimensions are possible, of course. For example, the cross section of the inner contour of claw strips 12, 68, 82, 102, and 112 may turn out to be larger.

There has thus been shown and described a novel connection element for sheet piles which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A sheet pile connection element comprising:

a central strip and two hook strips extending from it that together form a claw strip with C-shaped cross section, wherein the ends of the hook strips face each other, wherein the ends define an open jaw, and wherein the center lines of the ends of the hook strips intersect outside the open jaw and at least one connection strip, offset from the claw strip, that includes a straight neck strip and a head strip with an oval cross section, wherein the major axis of the head strip with the oval cross section is perpendicular to the longitudinal axis of the neck strip and the width of the head strip along the major axis corresponds to two to three times the thickness of the neck strip, wherein the greatest width of the inner contour of the C-shaped claw strip corresponds to 2.9 to 3.75 of the thickness of the neck strip.

2. A sheet pile connection element as defined in claim 1, wherein the longitudinal axis of the neck strip of the connection strip is in alignment with the longitudinal axis of the central strip of the claw strip.

3. A sheet pile connection element as defined in claim 1, wherein the longitudinal axis of the neck strip of the connection strip extends at an angle ($\alpha$) to the longitudinal axis of the central strip in such a manner that the head strip faces away from the open jaw of the C-shaped claw strip.

4. A sheet pile connection element as defined in claim 3, wherein the angle ($\alpha$) at which the longitudinal axis of the neck strip is inclined to the longitudinal axis of the central strip lies in a range of 30° to 60°.

5. A sheet pile connection element as defined in claim 1, wherein the connection strip is formed by an intermediary strip which merges into the central strip of the C-shaped claw strip, the hook strips of which point away from one side of the central strip, wherein the longitudinal axis of the intermediary strip extends parallel to the longitudinal axis of the central strip, and wherein the longitudinal axis of the neck strip of the connection strip extends at a given angle ($\beta$) to the longitudinal axis of the intermediary strip, so that the longitudinal axis of the neck strip points away from the same side of the central strip as the hook strips of the C-shaped claw strip.

6. A sheet pile connection element as defined in claim 1, wherein a second connection strip is on the opposite side of the central strip opposite the open jaw of the claw strip.

7. A sheet pile connection element as defined in claim 1, wherein the width of the open jaw is about half the greatest width of the inner contour of the claw strip.

8. A sheet pile connection element as defined in claim 1, wherein the central strip extends into one of two hook strips of a second claw strip with C-shaped cross section, the hook strips extending toward each other mirror-symmetrically form an open jaw with their ends.

9. A sheet pile connection element as defined in claim 8, wherein the axis of symmetry of the second claw strip extends perpendicular to the axis of symmetry of the first claw strip.

10. A sheet pile connection element as defined in claim 8, wherein the two claw strips have approximately the same shape and dimensions.

11. A sheet pile connection element as defined in claim 1, wherein the contour of the cross section of the connection element in the region of the claw strip and the at least one connection strip is formed substantially as a succession of circular arcs.

12. A sheet pile connection element as defined in claim 1, wherein, in cross section, the total length of neck and head strips is about half the length of the claw strip.

13. A sheet pile connection element as defined in claim 4, wherein the angle ($\alpha$) is approximately 45°.

* * * * *